US006681457B2

(12) United States Patent
Okawa et al.

(10) Patent No.: US 6,681,457 B2
(45) Date of Patent: Jan. 27, 2004

(54) FIBER SURFACE FASTENER AND METHOD FOR FINISHING SAME

(75) Inventors: Mitsuhisa Okawa, Toyama-ken (JP); Masashi Doi, Toyama-ken (JP); Norinaka Hirokawa, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/208,301

(22) Filed: Jul. 30, 2002

(65) Prior Publication Data

US 2003/0106189 A1 Jun. 12, 2003

(30) Foreign Application Priority Data

Aug. 29, 2001 (JP) ..... 2001-260010

(51) Int. Cl.[7] ..... A44B 18/00; B32B 27/04

(52) U.S. Cl. ..... 24/451; 24/306; 24/443; 24/445; 24/448; 156/66

(58) Field of Search ..... 24/451, 452, 445, 24/448, 446, 450, 442, 306, 444, 443; 156/66

(56) References Cited

U.S. PATENT DOCUMENTS 3,399,425 A * 9/1968 Lemelson ..... 24/451
5,607,635 A * 3/1997 Melbye et al. ..... 264/169
5,699,593 A * 12/1997 Jackson ..... 24/445
5,830,298 A * 11/1998 Jackson ..... 156/66
6,069,294 A * 5/2000 Leclercq et al. ..... 156/66
6,316,088 B1 * 11/2001 Ogawa et al. ..... 428/297.4
6,393,673 B1 * 5/2002 Kourtidis et al. ..... 24/306

* cited by examiner

*Primary Examiner*—Victor Sakran
(74) *Attorney, Agent, or Firm*—Bell, Boyd & Lloyd LLC

(57) ABSTRACT

A finishing method for obtaining a fiber surface fastener, said method being capable of, with simple processes, firmly fixing entangling portions between a foundation cloth composed of knitted/woven structure or nonwoven fabric and base portions of engaging elements, further, the finishing method being capable of preventing coating agent from adhering to or solidifying on the protruding surfaces of the engaging elements, said surface fastener having excellent softness. While a fiber surface fastener in which a plurality of engaging elements are formed on a foundation cloth thereof is conveyed continuously, powdery hot-melt adhesive is applied to its engaging element formation face from a separate position, the surface fastener is heated at a temperature higher than a melting point of said adhesive for a required time so that the adhesive applied is melted between the base portions of the engaging elements and the foundation cloth, and then said surface fastener is cooled.

11 Claims, 3 Drawing Sheets

FIBER SURFACE FASTENER AND METHOD FOR FINISHING SAME

BACKGROUND OF THE INVENTION

1. Field of the Invention

The present invention relates to a finishing method for a fiber surface fastener in which a plurality of engaging elements are formed on a surface of a foundation cloth composed of woven fabric or nonwoven fabric and a fiber surface fastener obtained by the same finishing method.

2. Description of the Prior Art

In a surface fastener which is formed by knitting or weaving monofilament and/or multi-filament in a loop shape at the same time when the foundation cloth is knitted or woven, and in which a plurality of hook-like or loop-like engaging elements are formed on the foundation cloth face, if engagement/disengagement of said surface fastener is repeated without any special finish processing, the loop-like engaging elements are loosened inside a knitting/weaving structure of the foundation cloth so that the hook-like engaging elements come to slip out easily, thereby the engaging/disengaging function as a surface fastener being lost. In order to prevent such loss of the engaging/disengaging function, a surface opposite to a surface on which engaging elements of the foundation cloth are formed is coated with thermoplastic resin, so as to fix the knitting/weaving structure of the foundation cloth while the base portions of the engaging elements are fixed to the foundation cloth, the procedure generally being called back-coating.

Upon this back-coating, as disclosed in, for example, Japanese Utility Model Application Publication No. 3-8388, the foundation cloth of an elongated surface fastener is carried on a predetermined passage with its rear surface directed upward and, at a resin coating portion, a liquid-state coating material is poured from a coater having a doctor plate and a coating material is applied to the foundation cloth with an uniform thickness. Or, as disclosed in Japanese Utility Model Application Publication No. 4-14149, a surface fastener is carried with a coating face of a surface fastener in contact with a surface of a rotary roll whose bottom portion is dipped in a coating bath, so that that foundation cloth is coated with coating material.

On the other hand, the surface fasteners of this kind do not necessarily have engaging elements on only one surface of the foundation cloth. There are surface fasteners having engaging elements formed on both front and rear surfaces of the foundation cloth. Generally, when the engaging elements are formed on both of the front and rear surfaces of the foundation cloth, the hook-like male engaging elements are formed on one face while the loop-like female engaging elements are formed on the other face. Applying coating materials to such double-face surface fasteners is impossible by the coating methods disclosed in the above publications.

Accordingly, as disclosed in, for example, Japanese Patent Application Laid-Open No. 4-49904, resin whose 100% modulus is 60 kg/cm$^2$ or less is applied to an engaging element formation surface of the surface fastener in the form of solution or emulsion having the viscosity of 50 to 2000 centi poise with an air spray method and is dried in order to fix the surface fastener having the engaging elements to both of the front and rear surfaces of the foundation cloth. According to this coating method, fixing of knitting/weaving structure of the foundation cloth and fixing of the engaging elements to the foundation cloth can be achieved without losing softness of the surface fastener and penetration of a needle upon sewing operation is never inhibited.

Although coating by pouring down coating agent or coating through a roller as proposed by the above-described Japanese Utility Model Application Publication No. 3-8388 and Japanese Utility Model Application Publication No. 4-14149 are valid for a surface fastener in which the engaging elements are formed on only a single surface of the foundation cloth, not only the coating to the double-face surface fastener as described above is impossible, but also the application amount of the coating agent is inevitably increased and resin film is formed on its coating surface, so that resistance on a needle pierced upon sewing tends to increase.

On the other hand, although coating can be applied to the double-face surface by the coating method proposed in the above-described Japanese Patent Application Laid-Open No. 4-49904, part of the coating agent inevitably adheres to the engaging elements themselves and solidifies thereby inhibiting smooth engagement/disengagement function. Particularly, multi-filament is used for the loop-like female engaging elements and such female engaging elements require to be so constructed that respective filaments are sufficiently separated while front ends thereof are widened so as to be kept apart from each other in order to achieve engagement with and disengagement from the mating hook-like male engaging elements accurately. If coating is applied to the female engaging elements having such a structure with the airless spray method, not only coating agent adheres between the multi-filaments so that they are bonded and solidified, but also thin films may be formed on loops and further, it is difficult to feed the coating agent effectively up to the foundation cloth located at the base portions of the engaging elements.

The present invention has been achieved to solve the above-described conventional problems. More specifically, an object of the present invention is to provide a finishing method for obtaining a fiber surface fastener through a simple process, which is capable of, irrespective of the configuration of the engaging elements or the front/rear surfaces of the foundation cloth, accurately fixing the entangling portion between the foundation cloth composed of knitted/woven fabric or nonwoven fabric and the base portion of the engaging elements, and the entangling portion between yarns in the foundation cloth, that is, the entangling portion between fibers in the knitting/weaving structure of knitted/woven fabric or in base material of nonwoven fabric, and the entangling portion between a fiber in the base material and a loop fiber. Further, the finishing method is capable of inhibiting the coating agent from adhering to or solidifying on the surface of a protruded portion of the engaging element, reducing the entire amount of the coating agent used and obtaining a fiber surface fastener excellent in softness, thereby producing no obstacle in sewing processing and allowing the engaging elements to engage/disengage smoothly. Further, another object of the present invention is to provide a fiber surface fastener which is obtained according to the same finishing method.

SUMMARY OF THE INVENTION

This invention regards to a finishing method for fixing a fiber surface fastener including a plurality of engaging elements on a foundation cloth composed of knitted/woven cloth or nonwoven cloth using synthetic resin. The finishing method is characterized by comprising: carrying the surface fastener continuously; applying powdery hot-melt adhesive to the engaging-element-formation face of the carried surface fastener from a separate position; heating the surface fastener to which the powdery hot-melt adhesive is applied at a temperature not lower than the melting temperature of the adhesive for a required time so as to melt the applied adhesive; and cooling the surface fastener after the heating time elapses.

The hot-melt adhesive mentioned here is solid under normal temperatures and 100% of its component is solid compound mainly made of thermoplastic resin. Usually, the adhesive is melted inside an applicator by heating, and applied to and pressed against an object. Adhesion is completed several seconds after pressing. Examples of the thermoplastic resin, a main component of this hot-melt adhesive, are ethylene vinyl acetate copolymer, polyethylene, a tactic polypropylene, ethylene acrylate copolymer, saturated copolymerized nylon, saturated copolymerized polyester.

Usually, this kind of hot-melt adhesive is provided with tackifier which is soluble with thermoplastic resin, a main component of the adhesive, so as to provide adhesive with hot tack performance, and with wax, which lowers viscosity of adhesive. As the tackifier, rosin and rosin derivative, pinene base resin, or oil base carbon hydride resin are used. As wax, ordinarily, paraffin wax, microcrystalline wax, low molecular PE wax, Fisher/toropushe wax, modified wax, alpha olefin wax and the like are often used.

According to the present invention, preliminarily set amount of powdery hot-melt adhesive having such a composition is applied to the engaging element formation face of an elongated surface fastener which is composed of knitted/woven cloth or nonwoven cloth and carried continuously. This application is carried out, for example, through a roller with grooves which is rotated at a predetermined rotation speed so as to spray the powdery hot-melt adhesive charged in a hopper. The application amount is controlled by changing the rotation speed of the roller with grooves and the size of the grooves. Because the hot-melt adhesive sprayed is powdery, the hot-melt adhesive gathers at the base portion of each engaging element and on the surface of the foundation cloth due to vibration and the like during conveyance, so that the adhesive substantially never adheres to the engaging elements themselves, not only in the hook-like male engaging elements but also in the female engaging elements composed of a plurality of the loop-like filaments.

By heating the surface fastener applied with the hot-melt adhesive, only the hot-melt adhesive is melted. The viscosity at this time is desired to be low to keep high diffusibility of the adhesive. The melted hot-melt adhesive gathers mainly at entangling portions between the engaging elements and the foundation cloth, and entangling portions between fibers of the foundation cloth in case of knitted/woven fabric or entangling portions between the fibers of the foundation cloth and the loop fibers in case of nonwoven fabric. After the surface fastener passes a heating region, it is conveyed to a cooling region. Cooling at this cooling region can be carried out, for example, by feeding cool air actively, but it can also be carried out by self-cooling. The melted hot-melt adhesive is solidified by cooling so that it fixes the knitting/weaving structure of the foundation cloth or the entangling portions of the fibers and further fixes the entangling portions between the foundation cloth and engaging elements.

Time required for the aforementioned heating is preferably 5 to 15 minutes. The aforementioned heating may be executed just after the hot-melt adhesive is applied. Nevertheless, it is more preferable to heat the surface fastener before the application of the adhesive, because melting time of the hot-melt adhesive is reduced so as to increase finishing speed. The surface fastener finished in this way can be provided with softness and the adhesive can be applied effectively because the amount of the hot-melt adhesive applied can be controlled easily, and engaging elements and the foundation cloth made of knitted/woven fabric or nonwoven fabric can be fixed effectively by the adhesive. Consequently, a sewing thread can be pierced easily in sewing process, so that stability of the sewing operation is secured.

Further, because the powdery hot-melt adhesive is applied from the engaging element formation face side of the surface fastener, the entangling portions between the engaging elements and the foundation cloth and the entangling portions of yarns or fibers of the foundation cloth can be fixed accurately without allowing hot-melt adhesive to adhere to the engaging elements. Consequently, even if the skin touches the engaging elements, it does not feel rough and moreover, the engagement/disengagement is not disturbed. The present invention is applicable not only to the surface fastener having the engaging elements on both the front and rear faces of the foundation cloth but also to an ordinary surface fastener having the engaging elements on a single side of the foundation cloth.

Further, in the present invention, it is preferable to charge at least the foundation cloth of the surface fastener when the hot-melt adhesive is applied. Because the surface fastener which is a finishing object of the present invention is composed of synthetic fiber material, it is easily charged by friction. Therefore, the surface fastener is charged before it reaches the finishing process of the present invention during it passes a number of steps. On the other hand, the powdery hot-melt adhesive is easily adsorbed to a charged surface fastener because the adhesive is mainly composed of thermoplastic resin. This property enables the powdery hot-melt adhesive to be applied effectively to the surface fastener.

However, because electric charge is not achieved uniformly if the electric charge is executed naturally when the surface fastener is processed, the powdery hot-melt adhesive is never adsorbed equally. Thus, according to the present invention, in order to apply the powdery hot-melt adhesive uniformly to the engaging element formation face of the surface fastener, preferably, the surface fastener is charged uniformly again with a charging means after it is deprived of static electricity temporarily. Consequently, the powdery hot-melt adhesive sprayed from a supply portion can be attached uniformly to a charged region.

Moreover, it is preferable for the present invention to include removal of static electricity of the surface fastener. Although the removal of static electricity may be executed before the aforementioned charging of electricity, it is preferable that static electricity is removed further after charging. If static electricity is removed prior to charging, further uniform charging can be achieved by aggressive charging at a next step. If the powdery hot-melt adhesive is applied at this time, the same adhesive is supplied to the surface fastener uniformly, but it is also adsorbed by the engaging element itself. Thus, when the powdery hot-melt adhesive is melted by heat at following procedures, the adhesive is melted and solidified integrally while adhering to the surface of the engaging elements.

Therefore, if static electricity is removed after the powdery hot-melt adhesive is uniformly adsorbed by aggressive charging, the powder adsorbed by the engaging elements slips down along the surface of the engaging elements, so that the powder gathers around the base portions thereof and at the surface of the foundation cloth. Thus, no adhesive adheres or solidifies on the engaging elements at the time of melting and bonding by the subsequent heating process, so that the engaging elements can obtain smooth surfaces so as to exert their proper functions accurately.

Furthermore, it is preferable for the present invention to include vibrating of the surface fastener during application of said adhesive.

The powdery hot-melt adhesive applied to the surface fastener hardly adheres to the engaging elements even if no special operation is carried out, because it is powdery. However, when the surface fastener is charged as described above, if the surface fastener is vibrated aggressively at the same time of charging, most adhesive adsorbed and left on the surface of the engaging elements slips down to a foundation cloth side. As a result, almost 100% of adhesive is used for fixing the engaging elements and the knitting/weaving structure of the foundation cloth at the time of subsequent melting and bonding process, thereby enabling effective finish work without losing the function of the engaging elements. In the meantime, if static electricity is removed after the surface fastener is charged and adhesive is adsorbed by the surface fastener, the powdery hot-melt adhesive adsorbed by the surface of the engaging elements slips down further effectively by the vibration.

In addition, it is preferable to set the particle size of the hot-melt adhesive 500 $\mu$m or less. If the particle size of the hot-melt adhesive exceeds 500 $\mu$m, adhesive which does not reach the foundation cloth or the base portions of the engaging elements but is halted halfway appears, so that more adhesive bonds the engaging elements with each other or adheres to the engaging elements and solidifies, thereby affecting the engagement strength. Additionally, fixing strength of the knitting/weaving structure cannot be obtained enough despite of the amount of the adhesive applied.

It is preferable that the main component of the hot-melt adhesive is thermoplastic resin having adhesiveness to both the foundation cloth and the engaging elements.

The hot-melt adhesive is mainly composed of various thermoplastic resins as described above. On the other hand, the component material of the surface fastener is also various: For example, such thermoplastic resins as polyester, polyamide, polyacetal, polypropylene, and polyacrylonitrile are used alone or in combination. When one resin material is used for the surface fastener, hot-melt adhesive whose main component is the same as that of the surface fastener can be used. On the other hand, when different resin materials are used for the surface fastener, it is preferable to employ a hot-melt adhesive, whose main component is a resin having a high affinity with any of the resin materials of the surface fastener.

In the present invention, the engaging elements are formed on both front and rear surfaces of the foundation cloth and the powdery hot-melt adhesive can be applied to at least a formation side surface of the male engaging elements.

According to the basic finish principle of the present invention, as described above, because the hot-melt adhesive is powdery, the hot-melt adhesive can be applied directly to and fix the engaging element formation face of the surface fastener. Therefore, even in a surface fastener having the engaging elements on both the sides of the knitted/woven fabric, the engaging elements and foundation cloth can be fixed from both faces. In this case also, softness of the surface fastener is secured if the amount of the adhesive applied is adjusted, so that the knitting/weaving structure of the foundation cloth and the engaging elements can be fixed sufficiently without losing the piercing performance of a sewing thread.

However, in the fiber surface fastener having the engaging elements on both faces of the foundation cloth, the formation density of hook-like engaging elements composed of monofilament, which are male engaging elements, is generally smaller than the formation density of loop-like engaging elements composed of multi-filament, which are female engaging elements. In addition, because of the structural property of the male engaging elements, they easily disperse powdery hot-melt adhesive on the surface of the foundation cloth compared to a plurality of female loop-like engaging elements. Thus, to the surface fastener which engaging elements are formed on both front and rear faces of the foundation cloth of, powdery hot-melt adhesive is applied at least from the formation face side of the male engaging elements, to which the adhesive easily disperses on the foundation cloth face. As a result, it becomes easy to obtain a desired engagement function of the female loop-like engaging elements composed of multi-filament with the male hook-like engaging elements.

When the engaging elements are formed on a surface of the foundation cloth, the powdery hot-melt adhesive can be applied to the surface on which the engaging elements are formed. In the fiber surface fastener to be finished by applying this adhesive, the entangling portions of component yarns of this foundation cloth and the entangling portions between proximal end portions of the engaging elements and the component yarns of the foundation cloth are fixed at the formation face side of the engaging elements while little adhesive flows out to its opposite face. Thus, it is possible to obtain a fiber surface fastener, which has excellent softness as well as good piercing performance of a sewing thread.

The above-mentioned method can provide a fiber surface fastener including a plurality of engaging elements formed on the foundation cloth composed of knitted/woven cloth or nonwoven cloth, wherein the engaging element formation face of the foundation cloth and the base portions of the engaging elements are bonded and covered with a melted and solidified layer of the powdery hot-melt adhesive applied from the engaging element formation face side.

Such a fiber surface fastener is obtained by applying powdery hot-melt adhesive preliminarily from the engaging element formation face side of the foundation cloth, melting said adhesive by heating, and then bonding and solidifying the adhesive. Thus, even in the surface fastener having the engaging elements on both the front and rear faces, the foundation cloth and the engaging elements can be fixed. Consequently, not only the configuration of the foundation cloth becomes stable but also disengagement of engaging elements is prevented. Further, because the amount of the adhesive applied to the surface fastener can be controlled appropriately, its softness can be secured and the piercing performance of the sewing thread is improved, so as not to impose excessive strain to a sewing machine thereby ensuring durability and achieving a smooth sewing.

Said engaging elements include not only the hook-like engaging elements composed of monofilament and the loop-like engaging elements composed of multi-filament formed by knitting/weaving the monofilament, said hook- and loop-like engaging elements being formed upon ordinal knitting/weaving of the foundation cloth, but also the loop-like engaging element composed of nonwoven fabric component fiber protruded from the surface of nonwoven fabric. When nonwoven fabric is used, although the loop-like engaging elements include a portion which is melted and bonded because the hot-melt adhesive adheres partially, the engaging strength and separation resistance are not lowered a lot, so that they can bear actual use sufficiently.

In the fiber surface fastener, the engaging elements can be formed on both the front and rear faces of the foundation cloth and at least one face thereof can be bonded and covered with melted and solidified layer of the hot-melt adhesive. This structure is achieved only by the vapor-finishing principle of the present invention described above and there is little drop in the engagement performance due to this finish work and further, an original taste as fiber surface fastener is never lost.

Especially, the male engaging element formation face of the foundation cloth can be bonded and covered with melted and solidified layer of the hot-melt adhesive. As described above, the male hook-like engaging elements composed of monofilament have a smaller formation density than the female loop-like engaging elements composed of multi-filament. Further, from viewpoint of the structure, if the powdery hot-melt adhesive is applied from each formation face side, it is more likely to be dispersed on the surface of the foundation cloth when the adhesive is supplied from the male engaging element formation face side. Further, entangling portions between the foundation cloth and the female engaging elements formed on the rear face are exposed on this surface. Therefore, the powdery hot-melt adhesive applied from the side on which the male engaging elements are formed is dispersed effectively on the surface of the foundation cloth which is the proximal end portion of each engaging element, and it is melted and solidified. Therefore, not only the foundation cloth but also entangling portions between the foundation cloth and the male or female engaging elements are fixed firmly, thereby durability being improved.

DESCRIPTION OF THE PREFERRED EMBODIMENTS

Figure 1:
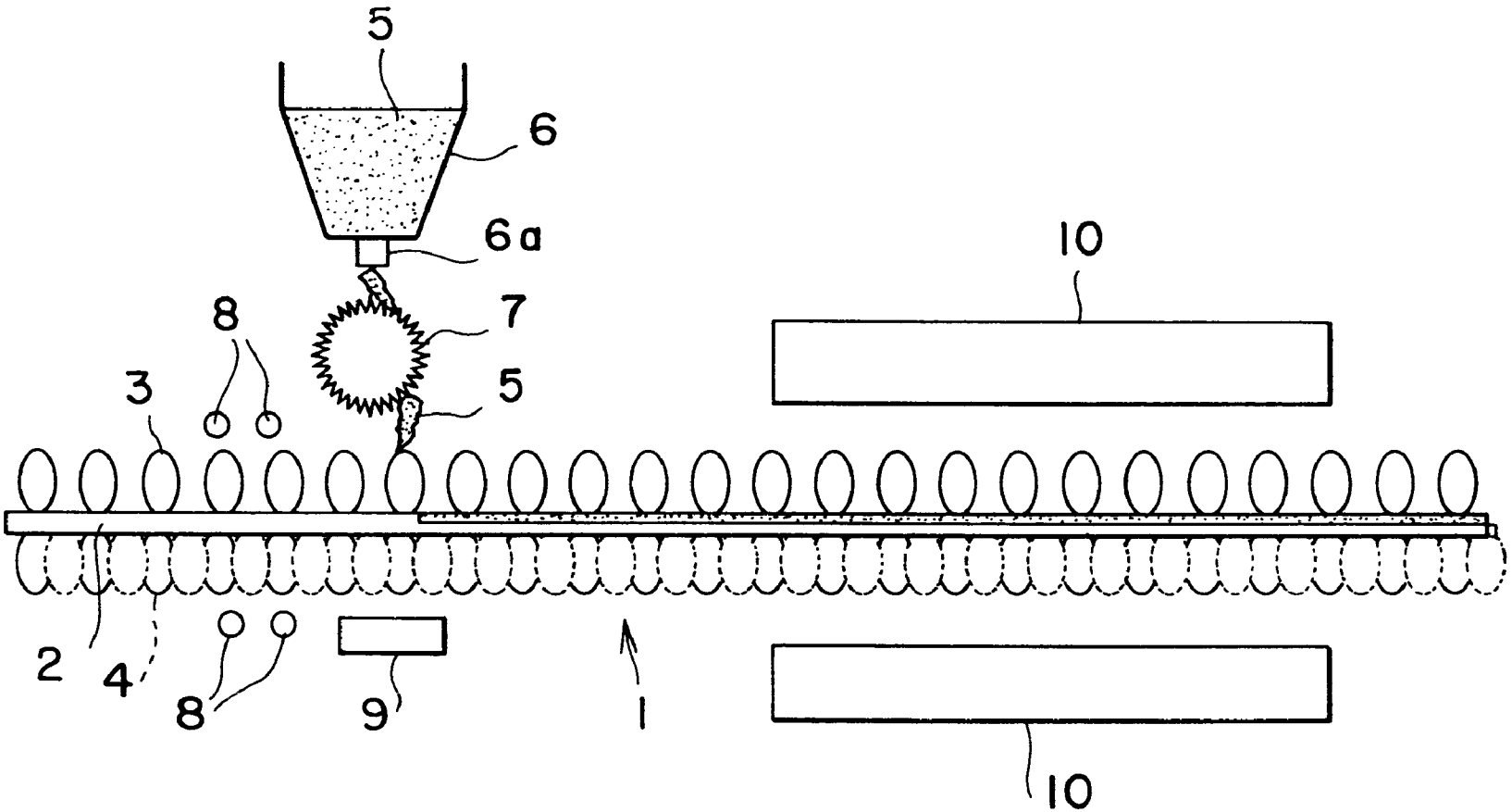
FIG. 1 is a process drawing schematically showing a finishing process for the surface fastener of the present invention.

Hereinafter, preferred embodiments of the present invention will be described in detail with typical examples. FIG. 1 shows a finish process for a surface fastener of the present invention schematically. As shown in FIG. 1, a surface fastener 1 is a double-faced surface fastener in which loops 3 for forming hook-like male engaging elements composed of monofilament are formed on an upper face of a knitted/woven foundation cloth 2, while loop-like female engaging elements 4 composed of multi-filament are formed on a lower face of the foundation cloth 2. FIG. 1 shows a state in which powdery hot-melt adhesive 5 is applied to a face in which the loops 3 are erected, prior to formation of the hook-like engaging elements.

Said hot-melt adhesive 5 is contained in a hopper 6 disposed at an upper side of a conveying passage for the surface fastener 1 and a specified amount of the hot-melt adhesive 5 drops from an adhesive drop port 6*a* a provided on a lower end of the hopper 6 to a surface of a spraying roll 7, which is disposed just below the adhesive drop port 6*a* and rotates under control, and whose surface is knurled. The powdery hot-melt adhesive 5 drops into groove portions of the spraying roll 7 and is carried downward as the spraying roll 7 rotates. Then, the powdery hot-melt adhesive is dispersed on the engaging element formation surface of the elongated surface fastener, which is conveyed continuously along the conveying passage of the surface fastener 1 and on which the loops 3, which will become the hook-like engaging elements later, are formed.

According to this embodiment, static electricity is removed from the conveyed surface fastener 1 just before the powdery hot-melt adhesive 5 is sprayed, and this surface fastener is charged just after it passes below the spraying roll 7. Thus, the power spraying system of Nikka Ltd. may be applied as the electrostatics removal/charging system. The static electricity of the surface fastener 1 which is carried with static electricity charged is removed by electrostatics removal bars 8 before it reaches just below the spraying roll 7. When the surface fastener 1 passes the spraying roll 7, the powdery hot-melt adhesive 5 to be sprayed from the spraying roll 7 is attracted by the charging bar 9, because electric field is formed by discharge by the charging bar 9 disposed below and just near the surface fastener 1 with the spraying roll 7 as another electrode. At this time, the surface fastener 1 is charged so that the powdery hot-melt adhesive 5 is adsorbed uniformly on the engaging element formation face of the surface fastener 1.

Next, the surface fastener 1 is conveyed to heating portions 10. The heating portions 10 are provided with heating regions disposed above and below the conveying passage for the surface fastener 1, and, during conveyance of the surface fastener 1, the heating portions 10 heat the surface fastener 1 from both the upper and lower faces so as to melt the hot-melt adhesive 5. Consequently, the melted hot-melt adhesive 5 spreads over the surface of the foundation cloth 2 and between the loops 3 and the foundation cloth 2. At this time, the surface fastener 1 passes through the heating portions 10 and after that, is cooled and solidified naturally. While part of solidified hot-melt adhesive 5 invades into the knitted/woven structure from the entangling portions of yarns thereof, it fixes the entangling portions between the base portions of the loops 3 and the foundation cloth 2. Afterwards, said loops 3 are partially cut out so that the hook-like male engaging elements are formed.

Before the surface fastener 1 is introduced into the heating portions 10, the static electricity can be removed again by an electrostatics removal portion (not shown). By this electrostatics removal process, a small amount of the hot-melt adhesive 5 adhering to the loops 3 gathers on the upper face of the foundation cloth 2 or at the base portions of the loops 3 by sliding on the surfaces of the loops 3 or dropping between the loops 3. Further, the surface fastener 1 can be vibrated by a vibrating source (not shown), at the same time when this surface fastener 1 is conveyed. This vibration helps the powdery hot-melt adhesive 5 adhering to the loops 3 to slide down effectively.

Although temperature of heating by the heating portions 10 varies depending on the kind of the hot-melt adhesive 5, at least, heating temperature to be set needs to be at least lower than the melting point of component materials of the surface fastener 1 (i.e. materials of yarns and engaging elements) and higher than the melting point of the hot-melt adhesive 5. Further, although its preferable heating time differs depending on the kind of the hot-melt adhesive 5 and the heating method, it is sufficient if the heating time is long enough to melt the hot-melt adhesive 5 completely, which is usually 5 to 15 minutes.

Although the amount of the hot-melt adhesive 5 applied differs depending on the properties (foundation cloth formation, yarn diameters, knitting/weaving densities, multi-filament sizes, monofilament diameters, and others) of the surface fastener 1, it is not always true that the fixing becomes firmer if the amount of the adhesive applied becomes larger, as understood from the embodiments described later. The same thing can be said for the heating time. Meanwhile, the preferred amount of the hot-melt adhesive 5 applied differs between the hook-like engaging element formation face and the loop-like engaging element formation face.

The hot-melt adhesive 5 which drops from the engaging element formation face when the hot-melt adhesive 5 is sprayed or the surface fastener 1 is conveyed is absorbed and collected by an aspirator (not shown). This hot-melt adhesive 5 is accommodated in the hopper 6 and sprayed again to the engaging element formation face. As compared to the air-spray method, collection of the adhesive is easier so that no adhesive is wasted.

Hereinafter, this invention will be described in detail with embodiments.

In the embodiments described below, a test piece of 5 cm×5 cm was made as a surface fastener and 10 specimens were finished under each of the following processing conditions. Table 2 shows average values of their properties. In these embodiments, the surface fasteners were fixed at specific positions without being carried, and heated for a specified time, and after that, the heating source was turned off and self-cooling was employed.

The surface fastener, which composed the test pieces, was woven by using nylon multi-filaments of 155 dT/12 f for warp yarns and of 110 dT/24 f for weft yarns of the foundation cloth, nylon monofilaments of 400 dT for the hook-like engaging elements, and nylon multi-filaments of 235 dT/7 f for the loop-like engaging elements. The monofilaments for the hook-like engaging elements and the multi-filaments for the loop-like engaging elements form a loop on every other weft yarn. Each loop is formed alternately across a single warp yarn. The double-faced surface fastener obtained in this way was cut to squares of 5 cm×5 cm as the test pieces.

Each processing condition is as follows.

(1) Hot-melt Adhesive

Hot-melt adhesive having a particle size of 80 to 160 $\mu$m, mainly composed of copolymer nylons A and B each having a different physical property as shown in Table 1, was used.

TABLE 1

| Main component of hot-melt adhesive | | A | B |
|---|---|---|---|
| Melting point (° C.) | | 110 | 98 |
| MFI (g/10 min) | 130° C. | 20 | 100 |
| | 140° C. | 50 | |
| | 150° C. | 74 | |
| | 160° C. | 100 | |
| Melting viscosity (Pa · s) | 130° C. | 400 | 100 |
| | 140° C. | 300 | |
| | 150° C. | 200 | |
| | 160° C. | 100 | |
| Bonding condition | Temperature (° C.) | 100–130 | 100–130 |

TABLE 1-continued

| Main component of hot-melt adhesive | A | B |
|---|---|---|
| Time (sec) | 5–10 | 5–10 |
| Pressure (hPa) | 200–300 | 200–300 |

(2) Heating (Processing) Time, Heating Temperature and Amount of Hot-melt Adhesive The amount of the hot-melt adhesive A was set to be selectable from 33.5 g/m$^2$, 40.2 g/m$^2$ and 46.1 g/m$^2$ and the amount of the hot-melt adhesive B was set to be selectable from 21.5 g/m$^2$, 30.9 g/m$^2$, 31.7 g/m$^2$ and 40.7 g/m$^2$. Test pieces twice as many as a necessary number (i.e. for the hook-like engaging element formation face and the loop-like engaging element formation face) were prepared for heating time of 5 minutes, 10 minutes and 15 minutes. Said hot-melt adhesive was applied to the engaging element formation face of each test piece by changing the condition, heated at 150° C. for the aforementioned time interval, and, after that, the adhesive was solidified by self-cooling.

(3) Pulling Strength

Ten hook-like or loop-like engaging elements were pulled out from each test piece after processed. The pulling strength (g) was calculated by dividing the strength (g) for pulling out the engaging elements by the amount of the hot-melt adhesive (g/m$^2$).

The pulling strength of the test pieces processed under the above-described conditions is summarized in Table 2.

TABLE 2

Amount of hot-melt adhesive applied and pulling strength

| Powder | Amount of adhesive (g/m$^2$) | Heat treatment time: 5 min. HOOK | Heat treatment time: 5 min. LOOP | Heat treatment time: 10 min. HOOK | Heat treatment time: 10 min. LOOP | Heat treatment time: 15 min. HOOK | Heat treatment time: 15 min. LOOP |
|---|---|---|---|---|---|---|---|
| A | 33.5 | 28.6 | 18.8 | 34.6 | 22.7 | 39.1 | 22.7 |
| | 40.2 | 28.1 | 18.9 | 33.6 | 14.2 | 30.1 | 20.6 |
| | 46.1 | 27.8 | 22.6 | 28.0 | 22.4 | 29.5 | 20.4 |
| B | 21.5 | 56.7 | 32.6 | 49.3 | 25.1 | 47.4 | 27.0 |
| | 30.9 | 42.4 | 23.0 | 39.5 | 23.0 | 37.9 | 18.4 |
| | 31.7 | 35.6 | 22.1 | 42.9 | 28.1 | 39.1 | 26.8 |
| | 40.7 | 28.3 | 15.7 | 33.7 | 22.9 | 37.1 | 25.3 |

*Values obtained by dividing pulling strength by the amount of adhesive.

What is understood from Table 2 is that hot-melt adhesive mainly composed of the component B having a lower melting point has higher pulling strength than adhesive mainly composed of the component A. The pulling strength of the loop-like engaging elements was sufficient for practical use, though it was lower than that of the hook-like engaging elements in all treatments. What should be noticed is that even if the amount of the hot-melt adhesive or processing time is increased, the pulling strength does not rise always. Therefore, the optimum amount of the hot-melt adhesive and heating time need to be determined considering the composition of the adhesive and component material and structure of the surface fastener.

Figure 2:
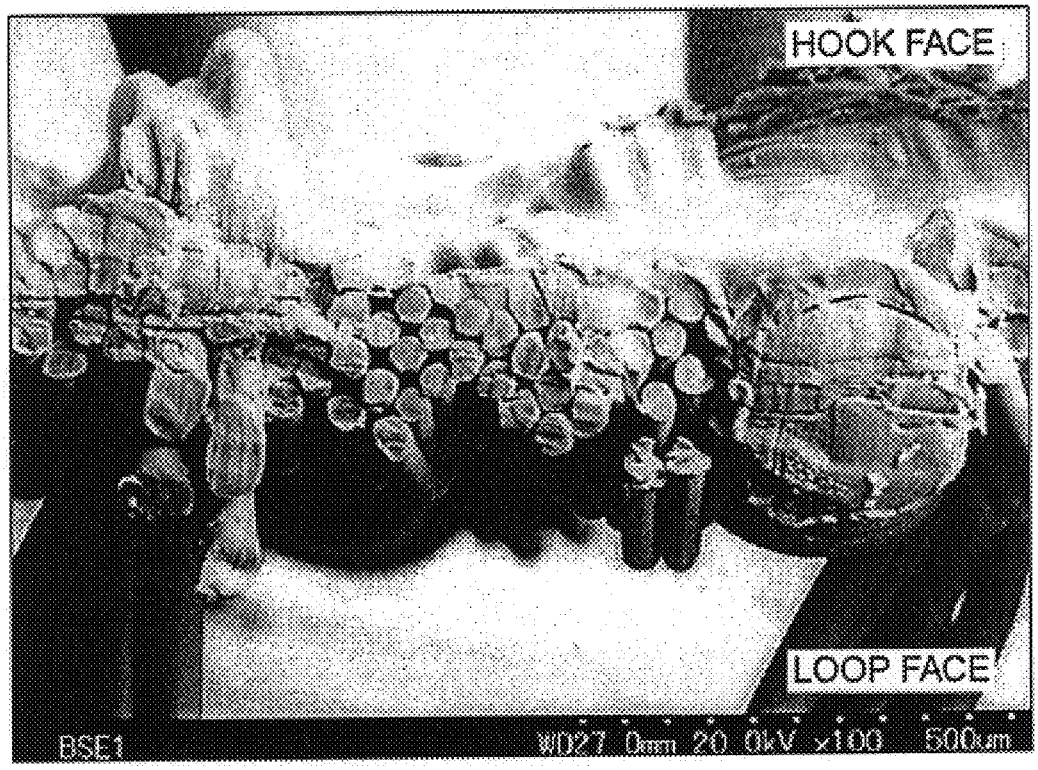
FIG. 2 is structural views shown by electron microscopic photographs showing a surface fastener processed from the formation face side of the hook-like engaging elements according to the finishing method of the present invention.
Figure 2:
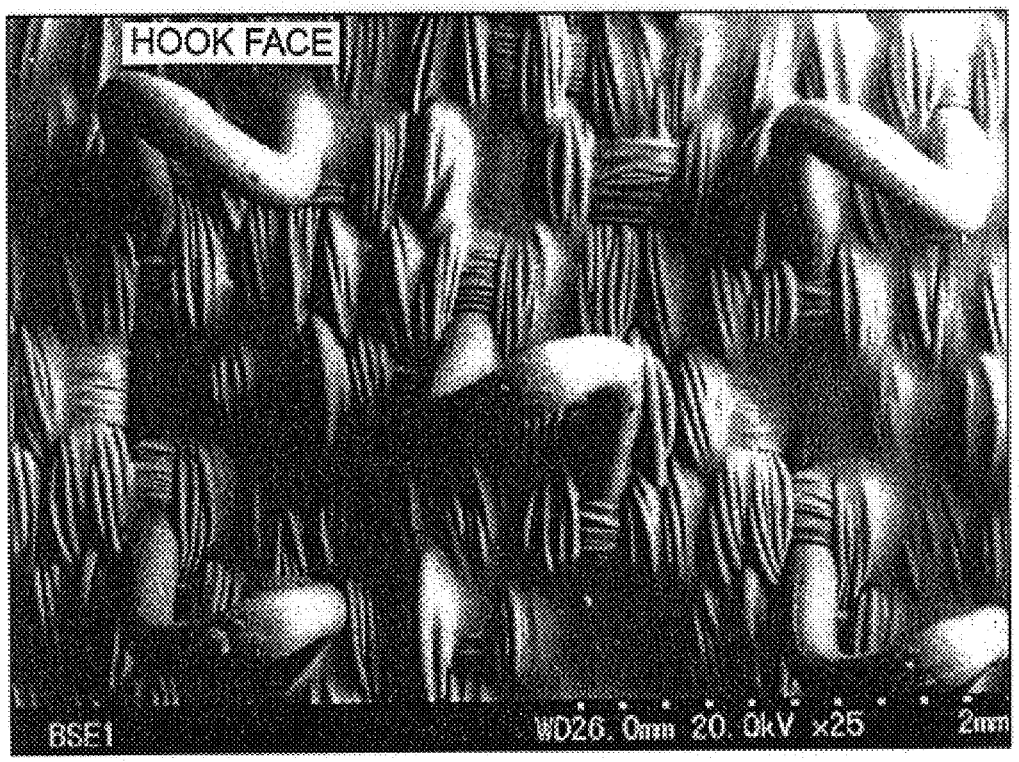
Figure 3:
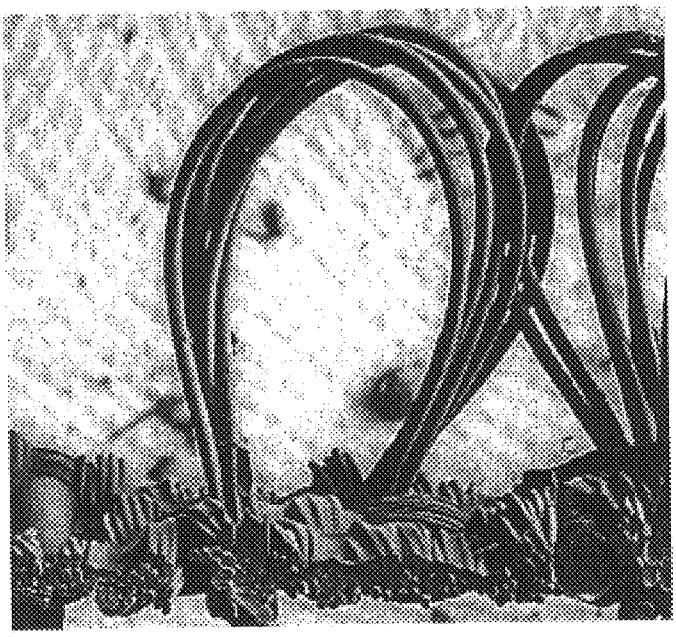
FIG. 3 is a structural view shown by an electron microscopic photograph showing a surface fastener processed from the formation face side of the loop-like engaging elements according to the finishing method of the present invention.
Figure 4:
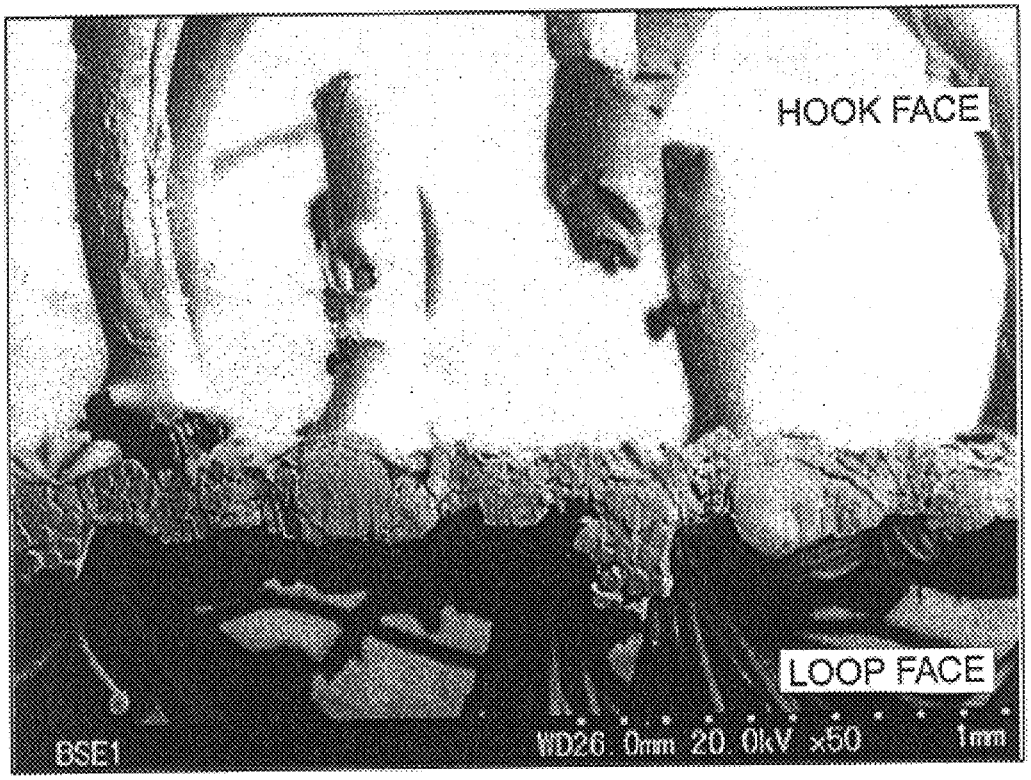
FIG. 4 is a structural view shown by an electron microscopic photograph showing a surface fastener processed from the formation face side of the hook-like engaging elements according to a conventional airless spray method.

FIG. 2 shows electron microscopic photographs of the processed face and section of a surface fastener treated from the formation face side of the loops, which form the hook-like engaging elements composed of monofilaments according to the finishing method of the present invention. FIG. 3 is an electron microscopic photograph of the processed face and section of a surface fastener treated from the formation face side of the loop-like engaging elements composed of multi-filaments according to the finishing method of the present invention. FIG. 4 is an electron microscopic photograph of a section of a surface fastener, treated from the formation face side of the hook-like engaging elements according to a conventional airless spray method.

As understood from FIGS. 2 and 3, little excessive resin adhering to the engaging elements themselves is found in the surface fastener processed according to the finishing method of the present invention. To the contrary, in the surface fastener processed according to the conventional airless spray method, as shown in FIG. 4, the surfaces of the hook-like engaging elements are covered with thin films and part of these films are peeled out, so that a number of scales adhere in a solidified condition. Moreover, in the conventional method, all multi-filaments, which are component yarns of the foundation cloth, are bonded by resin so that they are integrated. In contrast, in case of the surface fastener finished with the hot-melt adhesive of the present invention, although filaments composing yarns of the foundation cloth exposed on the application side of the adhesive are bonded integrally by the hot-melt adhesive, it does not fix other component filaments firmly.

This indicates that the conventional airless spray method is incapable of carrying out processing from the formation face side of the loop-like engaging elements. Moreover, even when processing is carried out from the formation face side of the hook-like engaging elements, the surfaces of the engaging elements are rough, indicating that smooth engagement with/disengagement from mating loop-like engaging elements is unlikely to be carried out. Further, the amount of resin adhering to the engaging elements rises, and the amount of resin to be applied increases to a large extent compared to the amount of resin substantially necessary for fixing the knitting/weaving structure and engaging elements of the foundation cloth. Consequently, final control of softness of the surface fastener is difficult.

In contrast, according to the finishing method of the present invention, the amount of adhesive adhering to the engaging elements is extremely small and most of the resin gathers on the foundation cloth and the base portions of the engaging elements. Therefore, the actual amount of adhesive applied coincides substantially with the amount of adhesive necessary for fixing the knitting/weaving structure of the foundation cloth and the engaging elements, so that effective fixing can be carried out. Further, if the amount of the adhesive applied is controlled, required fixation can be achieved without losing softness of the foundation cloth. Moreover, the surfaces of the engaging elements are not rough when touched. The processing method of the present invention enables processing from respective formation sides of the hook-like engaging elements and the loop-like engaging elements, thereby realizing firm fixation of the knitting/weaving structure of the foundation cloth and engaging elements.

When the same processing as described above was carried out on nonwoven fabric having fine loop-like engaging elements on its surface, though part of the hot-melt adhesive was observed fusing with part of the engaging elements, the engagement strength and peeling resistance thereof did not decrease substantially compared to the one subjected to ordinal back coating, and the surface fastener can be used practically.

What is claimed is:

1. A finishing method for a fiber surface fastener for fixing a fiber surface fastener, in which a plurality of engaging elements are formed on a foundation cloth composed of any one of knitted, woven and nonwoven cloth, with synthetic resin, wherein said finishing method includes:

conveying said surface fastener continuously;

applying powdery hot-melt adhesive from a separate position to an engaging element formation face of said surface fastener to be conveyed;

heating said surface fastener to which the powdery hot-melt adhesive has been applied at a temperature higher than a melting point of said adhesive for a required time so as to melt said adhesive applied; and cooling said surface fastener after said heating time elapses.

2. A finishing method for a fiber surface fastener according to claim 1, wherein said finishing method includes charging at least the foundation cloth of said surface fastener when said hot-melt adhesive is applied.

3. A finishing method for a fiber surface fastener according to claim 2, wherein said finishing method includes removing static electricity of said surface fastener.

4. A finishing method for a fiber surface fastener according to claim 1, wherein said finishing method includes vibrating said surface fastener during application of the hot-melt adhesive.

5. A finishing method for a fiber surface fastener according to claim 1, wherein particle size of said hot-melt adhesive is 500 $\mu$m or less.

6. A finishing method for a fiber surface fastener according to claim 1, wherein a main component of said hot-melt adhesive is thermoplastic resin having adhesiveness to both said foundation cloth and said engaging elements.

7. A finishing method for a fiber surface fastener according to claim 1, wherein said engaging elements are formed on both front and rear faces of said foundation cloth and the powdery hot-melt adhesive is applied to at least the formation side surface of male engaging elements.

8. A finishing method for a fiber surface fastener according to claim 1, wherein said engaging elements are formed on a surface of said foundation cloth and the powdery hot-melt adhesive is applied to the surface on which the engaging elements are formed.

9. A fiber surface fastener including a plurality of engaging elements integrally formed beforehand on a foundation cloth composed of any one of knitted, woven and nonwoven cloth, wherein an engaging element formation face of said foundation cloth and base portions of the engaging elements are bonded and covered with a melted and solidified layer of powdery hot-melt adhesive applied from an engaging element formation face side.

10. A fiber surface fastener according to claim 9, wherein said engaging elements are formed on both front and rear faces of the foundation cloth and at least one face thereof is bonded and covered with the melted and solidified layer of said hot-melt adhesive.

11. A fiber surface fastener according to claim 9, wherein a male engaging element formation face of said foundation cloth is bonded and covered with the melted and solidified layer of said hot-melt adhesive.

* * * * *